United States Patent [19]

Nelson

[11] 4,181,998

[45] Jan. 8, 1980

[54] TUBE CLEANING APPARATUS

[75] Inventor: Dana W. Nelson, Dexter, Ohio

[73] Assignee: Carrier Corporation, Syracuse, N.Y.

[21] Appl. No.: 930,113

[22] Filed: Aug. 1, 1978

[51] Int. Cl.[2] ..... B08B 9/02

[52] U.S. Cl. ..... 15/104.14

[58] Field of Search ..... 15/104.09, 104.1 R, 15/104.1 C, 104.14, 104.12, 104.13, 104.18, 104.3 SN, 72, 213; 134/8

[56] References Cited

U.S. PATENT DOCUMENTS

| | | | |
|---|---|---|---|
| 588,830 | 8/1897 | Jones | 15/104.14 X |
| 1,658,617 | 2/1928 | Swartz et al. | 15/104.14 |
| 2,597,263 | 5/1952 | Rodgers | 15/104.14 |
| 2,628,379 | 2/1953 | Darrah | 15/72 |

*Primary Examiner*—Edward L. Roberts

*Attorney, Agent, or Firm*—J. Raymond Curtin; John S. Sensny

[57] ABSTRACT

A tube cleaning apparatus comprising a frame for attachment to a rotatable drive shaft, and a plurality of arms connected to the frame for movement between an extended position and a retracted position. The apparatus also comprises a plurality of cutter heads secured to the arms for engaging the inside surface of the tube, wherein the cutter heads are spaced from the inside surface of the tube when the arms are in the retracted position, and biasing means for urging the arms to the retracted position. Also disclosed is a method of operating the tube cleaning apparatus.

3 Claims, 3 Drawing Figures

TUBE CLEANING APPARATUS

BACKGROUND OF THE INVENTION

This invention relates to apparatus for cleaning the interior of tubes, and more specifically to tube cleaning apparatus having swingable cutter arms.

Over a period of time, the insides of fluid conducting tubes develop scale, rust, or other deposits. Accordingly, the interiors of the tubes must be periodically cleaned. Often this is done by utilizing an apparatus having a body that can be secured to a rotatable drive shaft; a plurality of cutter arms, which are pivotally connected to the body for movement between a retracted position and an extended position; and a plurality of cutter heads, with one cutter head secured to each cutter arm. To clean a tube, the apparatus is inserted into the tube and rotated by the drive shaft. When rotated, the cutter arms, acting under the influence of centrifugal force, move radially outward to the extended position, and the cutter heads come into engagement with the interior of the tube. Further rotation scrapes the cutter heads across the inside surface of the tube, dislodging deposits from that surface. Typical prior art devices are disclosed in U.S. Pat. Nos. 928,432; 1,472,255; and 2,079,190. These references, along with U.S. Pat. No. 3,525,111 which is discussed below, appear to be the prior art known to applicant which is most relevant to the present disclosure.

With the prior art devices, it is often difficult to guide the cleaning apparatus into a tube because the cutter arms, being pivotally connected to the body, may swing outward as the apparatus is moved toward the tube. The cutter arms may strike the rim of the tube, preventing or at least hampering entry of the cleaning apparatus into the interior of the tube. This difficulty is compounded by the fact that occasionally the apparatus is rotated before it is inside the tube, further tending to swing the cutter arms to an outward position. Commonly, a considerable amount of attention and time, often involving expensive manual labor, must be taken to carefully insert the cutter arms into the tube.

In accordance with the present invention, means are provided to urge the cutter arms together to the retracted position. As the apparatus is inserted into a tube, the cutter arms are restricted from swinging outward, substantially facilitating entry of the cleaning apparatus into the tube. With the present invention, less time, skill, attention and expensive manual labor is needed to guide the apparatus into the tube.

Means for urging arms in a specific direction, wherein the arms are pivotally connected to a body which is rotated while moved through a tube, are disclosed in the last of the four above-cited references, U.S. Pat. No. 3,525,111. The apparatus shown in this patent, however, urges the arms outward to an extended position for maintaining contact between the arms and the interior of the tube. Thus, both the specific purpose—outwardly urging the arms—and the general purpose—maintaining contact between the arms and the interior surface of the tube—of the device disclosed in this latter patent are the opposite of those of the present invention. It is contended, hence, that this reference does not disclose or suggest means for urging cutter arms of a rotatable tube cleaning device together to a retracted position.

SUMMARY OF THE INVENTION

An object of this invention is to improve tube cleaning devices.

Another object of the present invention is to facilitate entry of a rotatable cutter arm tube cleaning device into a tube.

A further object of this invention is to reduce the amount of manual labor involved in guiding rotatable cutter arms into a tube.

A still another object of the present invention is to provide a method for biasing the cutter arms of a rotatable cutter arm tube cleaning device to a retracted position.

These and other objectives are attained with a tube cleaning apparatus comprising a frame for attachment to a rotatable drive shaft, and a plurality of arms connected to the frame for movement between an extended position and a retracted position. The apparatus also comprises a plurality of cutter heads secured to the arms for engaging the inside surface of the tube, wherein the cutter heads are spaced from the inside surface of the tube when the arms are in the retracted position, and biasing means for urging the arms to the retracted position.

DETAILED DESCRIPTION OF THE PREFERRED EMBODIMENT

Figure 1:
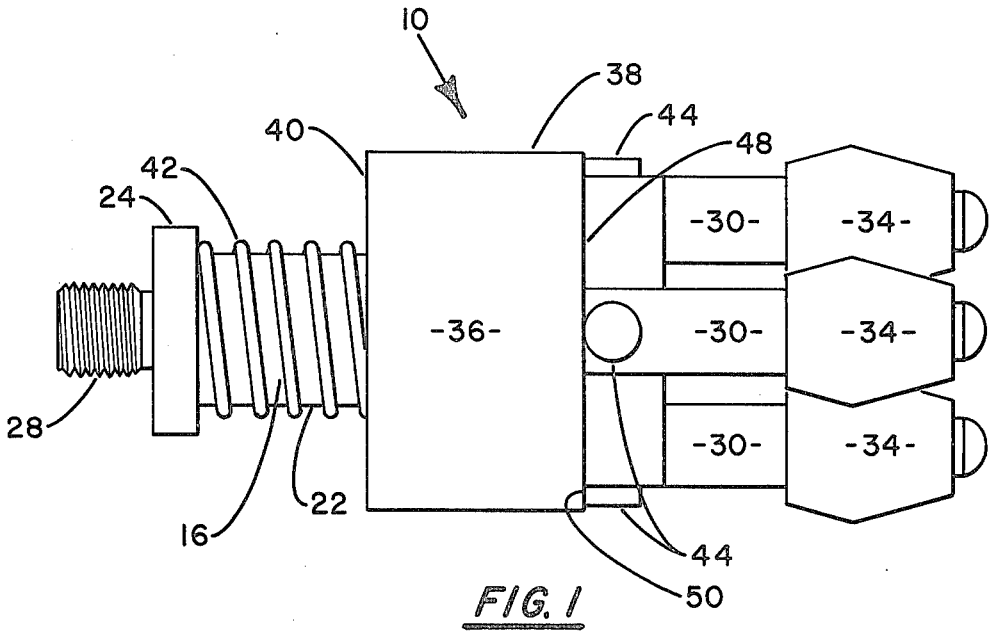
FIG. 1 is a side plan view of the rotatable cutter arm tube cleaning apparatus of the present invention.

Referring to the drawings, there is shown a rotatable cutter arm tube cleaning apparatus 10, which is the subject of the present invention. Apparatus 10 comprises a frame 12 which, in turn, includes a body 14 and a shaft adapter 16. Body 14 includes a longitudinal section 18 and a radially extending front shoulder 20 which, preferably, encircles longitudinal section 18. Similarly, shaft adapter 16 includes a longitudinal section 22 and a radially extending rear shoulder 24 which, preferably, encircles longitudinal section 22 and is spaced from front shoulder 20. Body 14 and shaft adapter 16 are generally coaxial, may be separated from each other, and are joined together by, for example, screw threads 26. As viewed in the drawings, the left, or rear, end of shaft adapter 16 is provided with a screw threaded segment 28 or with any other suitable means for the attachment thereto of a rotatable drive shaft (not shown).

Figure 2:
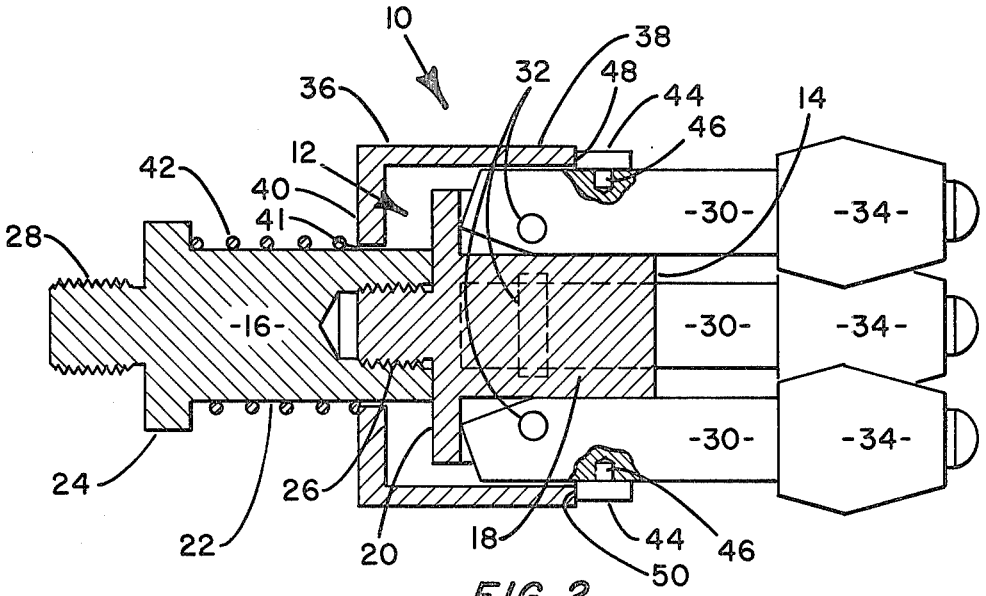
FIG. 2 is a side view partially in plan and partially in cross section of the apparatus shown in FIG. 1, with the cutter arms in the retracted position.
Figure 3:
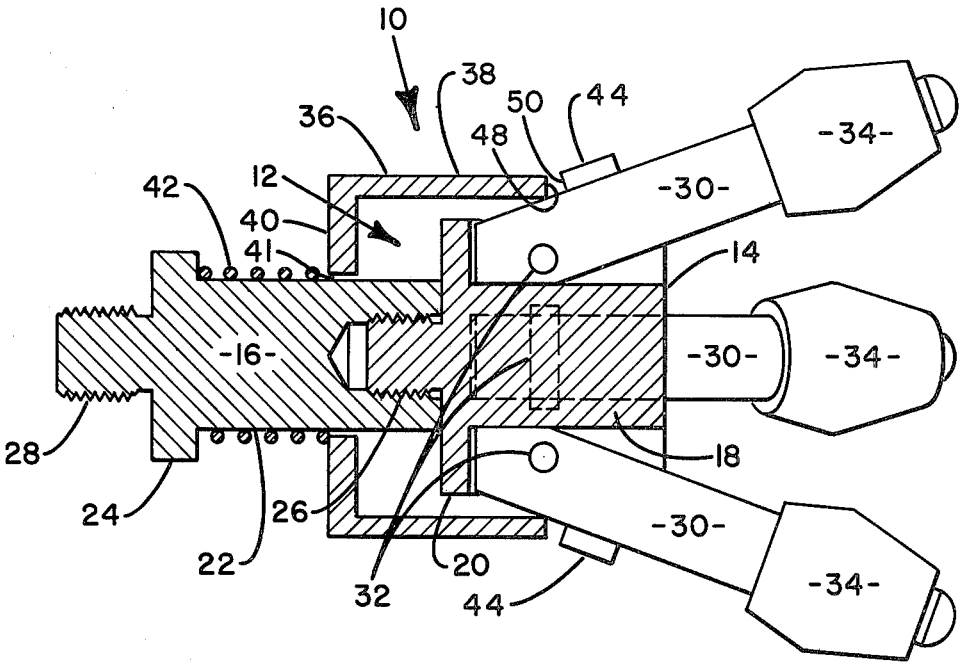
FIG. 3 is a side view partially in plan and partially in cross section of the apparatus shown in FIG. 1, with the cutter arms in an extended position.

Apparatus 10 further comprises a plurality of longitudinally extending cleaner or cutter arms 30, which are movably connected to frame 12 for movement between a retracted position shown in FIGS. 1 and 2 and an extended position shown in FIG. 3. Preferably, tube cleaning apparatus 10 includes four, symmetrically spaced cutter arms 30. One end of each cutter arm 30 is pivotally connected to body 14 by a pin or shaft 32 at a location which is forward of front shoulder 20. Apparatus 10 also comprises a plurality of cutter heads 34, with one cutter head secured to a second end of each cutter arm 30. More detailed descriptions of the construction of body 14, cutter arms 30, and cutter heads 34 are given in the above-mentioned U.S. Pat. Nos. 928,432; 1,472,255; and 2,079,190.

Tube cleaning apparatus 10 also comprises a cylindrical sleeve 36 movably supported by frame 12. A first or front end 38 of sleeve 36 encircles the outside surfaces of cutter arms 30. A second or back end of sleeve 36 defines a generally circular opening 41, and the sleeve is positioned so that longitudinal section 22 of shaft adapter 16 extends through opening 41, thereby slidably supporting the sleeve. Sleeve 36 is longitudinally movable along shaft adapter 16 toward or away from rear shoulder 24 between an open position, wherein back end 40 of the sleeve is adjacent the rear shoulder, and a closed position, wherein the back end of the sleeve is adjacent front shoulder 20. A small clearance is provided between longitudinal section 22 and the surface of back end 40 which defines circular opening 41 to prevent sleeve 36 from binding against the longitudinal section as the sleeve moves between the open and closed positions. Resilient means 42 such as a spring is supported by frame 12 for urging sleeve 36 away from rear shoulder 24 and toward the closed position. Preferably, spring 42 is supported by longitudinal section 22 of shaft adapter 16 and is located between rear shoulder 24 and back end 40 of sleeve 36.

When tube cleaning apparatus 10 is in an inactive or resting position, shown in FIGS. 1 and 2, sleeve 36 is held in the closed position by resilient means 42 and cutter arms 30 are held in the retracted position by sleeve 36. As an extending force, that is, a force urging cutter arms 30 toward the extended position, is applied to the cutter arms, the cutter arms exert a force on sleeve 36. The force which each cutter arm 30 exerts on sleeve 36 is in the direction in which the arm tends to move; and the force can be considered as being comprised of a longitudinal component, parallel to the longitudinal axis of body 14 and shaft adapter 16, and a radial component, perpendicular to the longitudinal axis of the body and shaft. Radial movement of sleeve 36 is prevented by abutting contact between the surface of back end 40 which defines opening 41 and longitudinal section 22 of shaft adapter 16. Longitudinal forces exerted on sleeve 36 by cutter arms 30 are opposed by resilient means 42. Until a predetermined extending force sufficient to enable cutter arms 30 to overcome the opposition of resilient means 42 is applied to the cutter arms, movement of sleeve toward the open position is prevented, maintaining the cutter arms in the retracted position. When the extending forces exerted on cutter arms 30 and, hence, the longitudinal forces exerted on sleeve 36 by the cutter arms are relatively small, for example when cutter arms 30 tend to swing about pins 32 due to motion of body 12 as the cutter arms are guided into a tube, the cutter arms are held in the retracted position and outward swinging movement of the cutter arms is significantly restricted. In this manner, as tube cleaning apparatus 10 is inserted into a tube, undesired swinging movement of cutter arms 30 is substantially eliminated, considerably facilitating entry of the cutter arms into the tube. The amount of skill and time needed to insert apparatus 10 into the tube is decreased, decreasing the cost of that process.

Once inside the tube, frame 12 and cutter arms 30 are rotated by means of the drive shaft, and the cutter arms are urged outward under the influence of centrifugal force. When this occurs, the longitudinal force exerted on sleeve 36 by cutter arms 30 increases. When this longitudinal force becomes greater than the opposing force of resilient means 42, cutter arms 30 force sleeve 36 rearward along shaft adapter 16 toward back shoulder 24 and toward the open position; and the cutter arms 30, since they are not otherwise restrained from outward movement about pins 32, pivot outward due to the centrifugal force. Rearward movement of sleeve 36 and outward swinging of arms 30 can continue until cutter heads 34 come into contact with the interior surface of the tube. Further rotation of tube cleaning apparatus 10 scrapes deposits and scales off the inside surface of the tube. The rotating tube cleaning apparatus 10 is moved through the tube, cleaning the interior of the tube. Outward swinging movement of cutter arms 30 is limited to the degree shown in FIG. 3 wherein back surfaces of the arms are in abutting contact with a surface of longitudinal section 18 of body 14, and this contact prevents further outward pivoting of the cutter arms.

Resilient means 42, acting through sleeve 36, constantly applies a retracting force to cutter arms 30 urging the cutter arms to the retracted position. When, as shown in FIG. 3, sleeve 36 is in the open position and cutter arms 30 are in an extended position, and the force exerted on sleeve 36 by resilient means 42 becomes greater than the longitudinal force exerted on the sleeve by cutter arms 30, the resilient means forces the sleeve forward to the right as viewed in the drawings, toward the closed position. Such a situation occurs, for example, when rotation of the drive shaft, body 14, and cutter arms 30 is terminated. As sleeve 36 moves forward, toward the closed position, it exerts a force on each cutter arm 30 at the area of contact between the sleeve and the cutter arm. The direction of this force is in the direction of movement of sleeve 36; and the force can be considered as being comprised of a first component, along the line between the center of the pin 32 securing the cutter arm 30 to body 14 and the center point of the contact area between the sleeve and the cutter arm, and a second component, perpendicular to this line. Pin 32 prevents cutter arm 30 from moving along the line between the pin and the area of contact between sleeve 36 and the cutter arm, but the cutter arm is free to rotate about the pin in a direction perpendicular to this line. That is, cutter arm 30 is able to rotate inward about pin 32 toward the retracted position. Thus, movement of sleeve 36 to the closed position provides a torque or leverage on each cutter arm 30, moving the cutter arms to the retracted position. In this way, sleeve 36 acts as a contacting member supported by frame 12 for movement between an open position and a closed position, wherein movement of the contacting member from the open position to the closed position moves cutter arms 30 to the retracted position. Cooperating as disclosed herein, sleeve 36 and resilient means 42 comprise biasing means supported by frame 12 for urging arms 30 to the retracted position.

The magnitude of the torque or leverage which sleeve 36 exercises on each cutter arm 30 is equal to the second component of the force exerted on the cutter arm by the sleeve—that is, the component of the force perpendicular to the line between the center point of pin 32 and the center point of the contact area between the sleeve and the cutter arm—multiplied by the distance between these two points. In the illustrated example, each cutter arm 30 is provided with a protrusion or stud 44 for increasing the leverage which sleeve 36 has on the cutter arm as the sleeve approaches the closed position. With this arrangement, as sleeve 36 approaches the closed position, a radial surface 48 of the sleeve comes into contact with a radial surface 50 of stud 44, moving the area of contact between the sleeve and the cutter arm outward onto the stud. The distance between the center point of pin 32 and the center point of the contact area between sleeve 36 and cutter arm 30 is increased, increasing the leverage which the sleeve exercises on the cutter arm.

While it is apparent that the invention herein disclosed is well calculated to fulfill the objects above stated, it will be appreciated that numerous modifications and embodiments may be devised by those skilled in the arts, and it is intended that the appended claims cover all such modifications and embodiment as found within the true spirit and scope of the present invention.

What is claimed is:

1. A tube cleaning apparatus comprising:

a frame for attachment to a rotatable drive shaft;

a plurality of arms connected to the frame for movement between an extended position and a retracted position;

a plurality of cutter heads secured to the arms for engaging the inside surface of the tube, wherein the cutter heads are spaced from the inside surface of the tube when the arms are in the retracted position;

a contacting member supported by the frame for movement between an open position and a closed position, wherein movement of the contacting member from the open position to the closed position moves the arms toward the retracted position; and resilient means supported by the frame for urging the contacting member to the closed position.

2. The tube cleaning apparatus of claim 1 wherein:

the frame includes a shoulder spaced from the arms;

the contacting member includes a sleeve slidably supported by the frame between the shoulder and the arms for movement therebetween, and having a first end which encircles the outside surfaces of the arms so movement of the sleeve away from the shoulder moves the arms toward the retracted position;

the resilient means includes a spring supported by the frame for urging the sleeve away from the shoulder; and further including:

a stud secured to an arm for increasing the leverage which the sleeve exercises on the arm.

3. In a tube cleaning apparatus of the type having a frame including a body and a shaft adapter for attachment to a rotatable drive shaft, a plurality of arms connected to the body for movement between an extended position and a retracted position, and a plurality of cutter heads secured to the arms for engaging the inside surface of a tube, wherein the cutter heads are spaced from the tube when the arms are in the retracted position, the improvement comprising:

a contacting member supported by the frame for movement between an open position and a closed position, wherein movement of the contacting member from the open position to the closed position moves the arms toward the retracted position; and resilient means supported by the frame for urging the contacting member to the closed position.

* * * * *